United States Patent [19]

Ashdown

[11] 4,085,708

[45] Apr. 25, 1978

[54] STEAM BOILERS

[75] Inventor: Ronald Arthur Ashdown, Redhill, England

[73] Assignee: Foster Wheeler Energy Corporation, Livingston, N.J.

[21] Appl. No.: 765,566

[22] Filed: Feb. 4, 1977

[30] Foreign Application Priority Data

Feb. 18, 1976 United Kingdom ..... 6464/76

[51] Int. Cl.[2] ..... F22B 1/18; F23J 5/00

[52] U.S. Cl. ..... 122/7 B; 110/182.5; 122/235 B; 431/5

[58] Field of Search ..... 122/7 R, 7 B, 235 B; 110/182.5; 431/5

[56] References Cited

U.S. PATENT DOCUMENTS

| | | | |
|---|---|---|---|
| 2,952,310 | 9/1960 | Nuyl et al. | 431/5 |
| 3,789,804 | 2/1974 | Aguet | 122/7 |
| 3,984,196 | 10/1976 | Zenkner | 431/5 |

FOREIGN PATENT DOCUMENTS

| | | | |
|---|---|---|---|
| 774,799 | 5/1957 | United Kingdom | 122/7 |

*Primary Examiner*—Kenneth W. Sprague
*Attorney, Agent, or Firm*—Marvin A. Naigur; John E. Wilson

[57] ABSTRACT

Described herein is a waste heat steam boiler which is capable of using as secondary combustion air, the exhaust gases from a steam turbine. The boiler has burners which are fed with primary combustion air by an air blower. This air is cool and can be used to keep part of the burners cool. The burners have throats supplied with secondary combustion air from a windbox which receives this secondary air either from the gas turbine or from a forced draught fan. The burner throats are adjustable between an open full quarl position when the secondary air is the gas turbine exhaust and a partially closed position where the effective quarl diameter is reduced when the secondary air is supplied by the forced draught fan.

4 Claims, 2 Drawing Figures

STEAM BOILERS

This invention relates to steam boilers and in particular boilers which are used to recover some of the waste heat in the hot exhaust gases from a gas turbine.

BACKGROUND TO THE INVENTION

A gas turbine for driving an electrical generator, compressor, or the like can be exhausted to a waste heat boiler to recover heat for steam generation and also provide combustion aid for firing additional oil or gas fuel to increase the steam generating capacity of the waste heat boiler.

A conventional forced draught fan is provided to supplement the combustion air supplied by the gas turbine and also to allow the waste boiler to operate as a conventional boiler when the gas turbine is not operating. The fuel burner or burners used, however, have to be designed to achieve efficient combustion when using either the very hot (900° to 1000° F say) turbine exhaust gas or the cool (80° F say) air supplied by the forced draught fan. To achieve this a double skin windbox with special burners having two quarls can be employed or the gas turbine exhaust can be introduced through apertures in the furnace adjacent to the fuel burners.

The use of a double skin windbox and these special burners leads to design and construction complications which it is desirable to avoid. In addition it is in the interests of efficiency to use the turbine exhaust gases as part of the combustion air for the burner or burners.

BRIEF DESCRIPTION OF THE INVENTION

Therefore according to the invention there is provided a waste heat steam boiler which has one or more fuel burners each arranged to be fed with primary combustion air by an air blower, the burner or burners having throats through which secondary air can be supplied from a windbox which can receive its secondary air from the exhaust of a gas turbine or from a forced draught fan, the burner throat or throats being adjustable between an open full quarl position and a partially closed position where the effective quarl diameter is reduced so that when the secondary air is supplied by the gas turbine the throat or throats can be in their open position and when the secondary air is supplied by the forced draught fan, the throat or throats can be in their partially closed position.

The invention also includes power plant comprising a gas turbine and such a steam boiler, the exhaust gases from the gas turbine being arranged to be fed to the windbox of the boiler.

The invention provides a number of advantages. Thus only a simple and conventional open windbox is required. The small primary air fan will supply a constant flow of cold air preferably about 10% of the total combustion air supply which will maintain the primary flame stability under all conditions particularly when stopping and starting the gas turbine. In addition it allows the main register draft loss to be reduced, thus allowing an increase in the gas turbine operating efficiency. The cold primary air can be used to keep the various fuel burner parts separate from the hot gas turbine exhaust thus avoiding expansion and handling problems.

The burners can be, for example, oil or gas burners.

The burner throat or throats can be adjusted manually or automatically to take account of the source of secondary air.

The size of the burner throat or throats can be adjusted by a false quarl which is movable between a retracted position where there is full communication between the windbox and the furnace interior and an advanced position where the false quarl partially blocks the throat. This false quarl can be in the form of a frusto conical restrictor.

BRIEF DESCRIPTION OF THE DRAWINGS

A power plant according to the invention will now be described, by way of example, with reference to the accompanying drawings, in which.

DESCRIPTION OF THE PREFERRED EMBODIMENT

Figure 1:
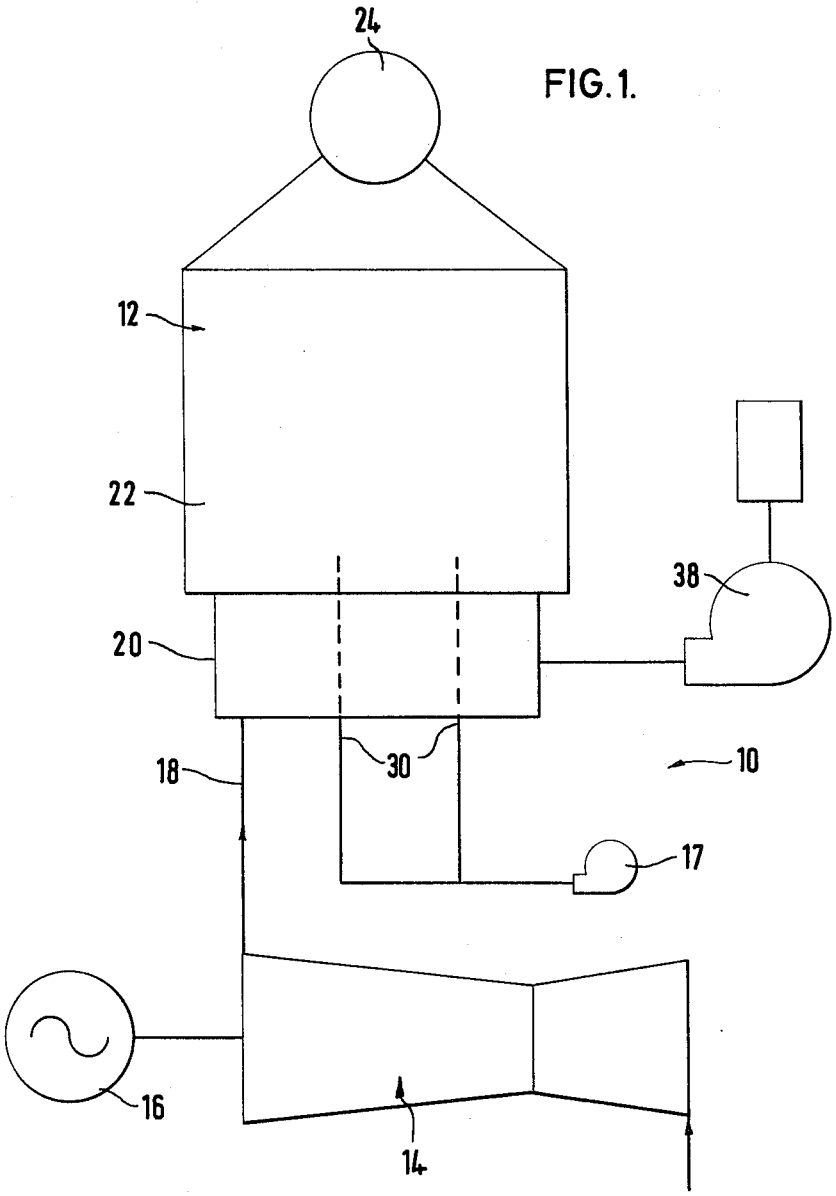
FIG. 1 is a diagram of the plant.

The plant 10 shown in the drawings includes a waste heat steam boiler 12 and a gas turbine 14 connected to a load 16. The hot exhaust gases from the gas turbine 14 pass along a conduit 18 to the windbox 20 of the boiler 12 to provide combustion air. Alternatively combustion air can be supplied from a forced draught fan 38.

Figure 2:
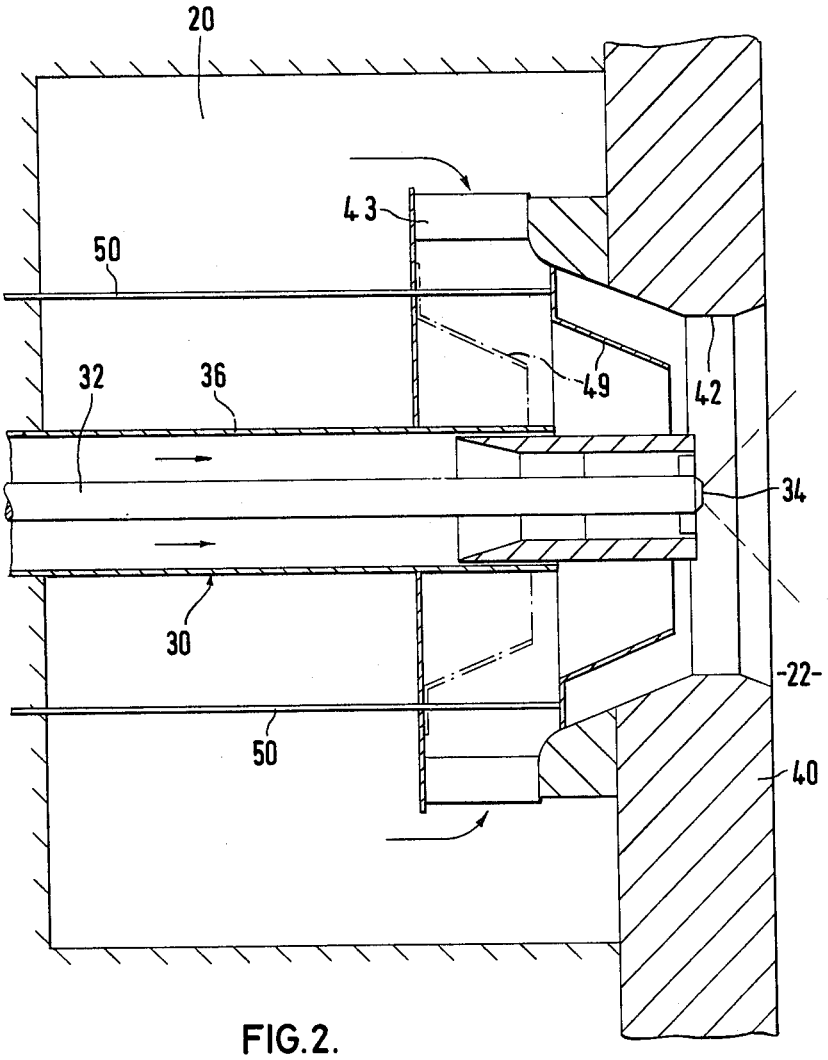
FIG. 2 is a section through a burner and its throat of the steam boiler of the plant.

The steam boiler includes a furnace 22, the combustion products from which pass to a stack 24. The boiler has at least one burner 30. A burner 30 is shown in more detail in FIG. 2.

This burner includes a central oil duct 32 carrying at its outer end an atomiser nozzle 34. Around the duct is a primary combustion air passage defined within a sleeve 36. This primary air, about 10% of the individual burner combustion air, is provided by a forced draught fan 17. This air is cool and so it shields the oil duct from the high temperatures of the hot exhaust gases from the turbine.

The wall 40 of the furnace has an opening or quarl 42 for the burner and fixed around this opening 42 is an air register 43 through which secondary combustion air from the windbox 20 passes through the opening 42 into the furnace. The flow of this secondary air is controlled by a false quarl 49. In its advanced position shown in solid lines the false quarl, partially blocks off the secondary air passage and it is placed in this position when the turbine is not working and combustion air is supplied by the forced draught fan 38. In its retracted position shown in dotted lines, the false quarl does not obstruct the flow of secondary air and so allows the turbine exhaust gases to flow freely into the furnace as secondary combustion air. The false quarl is moved between these positions by draw rods 50 which extend out through the windbox.

In such a plant the constant supply of primary air maintains the stability of the flame irrespective of whether the secondary combustion air is supplied by the turbine exhaust or the forced draught fan 38. The velocity of the secondary combustion air at the plane of the burner tip is controlled by the position of the false quarl, taking the form of a frusto-conical member or restrictor cone 49. When fully retracted for use with very hot exhaust gas operation the full quarl diameter is available and the gas passage is bounded by the outside of the cone and the quarl profile. When fully advanced however for operating with the cool secondary air from the forced draught fan 38 the air passage is bounded by the inside faces of the frusto-conical false quarl and the effective quarl diameter is the smaller diameter of the false quarl.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A power plant comprising:

(i) a waste heat steam boiler including walls defining a furnace, one of said walls having an opening formed therethrough, (ii) at least one fuel burner associated with said one furnace wall, one end of said burner adjacent said opening in said one wall, (iii) an air blower for supplying primary combustion air to said fuel burner, (iv) a windbox disposed adjacent said one wall to which secondary combustion air can be passed for supplying said burner, (v) a gas turbine including an exhaust section for passing heated exhaust gases including air from said turbine, (vi) a forced draught fan, (vii) means for supplying the exhaust from said turbine or the output from said forced draught fan to said windbox for use as secondary combustion air to be supplied to said burner, (viii) a throat associated with said opening in said one wall and adjacent said burner through which combustion products pass into said furnace, secondary combustion air passed into said throat from said windbox, and (ix) means for adjusting said throat between an open full quarl position when said secondary air is the exhaust from said turbine and a partially closed position where the effective quarl diameter is reduced when said secondary air is supplied by the forced draught fan.

2. A power plant according to claim 1 wherein said burner comprises a fuel nozzle, an axially extending tube for supplying fuel to said nozzle, and a sleeve extending through said windbox and surrounding said tube and means for supplying the primary air to said sleeve.

3. A power plant according to claim 1 wherein said means for adjusting said throat comprises a false quarl which is movable between a retracted position where theere is full communication between said windbox and said furnace and an advanced position where the false quarl partially blocks said throat, and means for moving said false quarl between the advanced and retracted positions.

4. A power plant according to claim 3 in which said false quarl is of frusto-conical form.

* * * * *